US008312936B2

(12) United States Patent
Wasielewski

(10) Patent No.: US 8,312,936 B2
(45) Date of Patent: Nov. 20, 2012

(54) LOCKOUT APPARATUS FOR PROTECTING AN ATTACHMENT DEVICE MOUNTED ON ROTARY POWER TOOLS

(75) Inventor: Kevin Wasielewski, Schaumburg, IL (US)

(73) Assignee: Robert Bosch GmbH, Stuttgart (DE)

( * ) Notice: Subject to any disclaimer, the term of this patent is extended or adjusted under 35 U.S.C. 154(b) by 352 days.

(21) Appl. No.: 12/700,345

(22) Filed: Feb. 4, 2010

(65) Prior Publication Data

US 2011/0186322 A1 Aug. 4, 2011

(51) Int. Cl.
*B25F 5/00* (2006.01)

(52) U.S. Cl. ..... 173/164; 173/213

(58) Field of Classification Search ..... 173/1, 213, 173/164

See application file for complete search history.

(56) References Cited

U.S. PATENT DOCUMENTS

| | | | | |
|---|---|---|---|---|
| 4,751,970 | A | 6/1988 | Hecker et al. | |
| 5,020,281 | A | 6/1991 | Neff | |
| 5,664,634 | A * | 9/1997 | McCracken | 173/48 |
| 6,048,260 | A | 4/2000 | Kopras | |
| 6,269,888 | B1 * | 8/2001 | Schuda et al. | 173/48 |
| 6,887,176 | B2 * | 5/2005 | Sasaki | 475/150 |
| 7,052,382 | B2 | 5/2006 | Baker | |
| 7,077,736 | B2 | 7/2006 | Uzumcu et al. | |
| 7,600,579 | B2 * | 10/2009 | Wasielewski | 173/217 |
| 2003/0173178 | A1 * | 9/2003 | Sasaki | 192/3.51 |
| 2009/0008282 | A1 * | 1/2009 | Wasielewski | 206/376 |
| 2009/0165892 | A1 * | 7/2009 | Baker et al. | 144/153 |
| 2010/0316457 | A1 * | 12/2010 | Wasielewski | 408/238 |
| 2011/0188957 | A1 * | 8/2011 | Wasielewski et al. | 408/72 B |

* cited by examiner

*Primary Examiner* — Brian D Nash

(74) *Attorney, Agent, or Firm* — Greer, Burns & Crain, Ltd.

(57) ABSTRACT

A power hand tool comprising an elongated housing with a nose portion having an opening concentric with a rotary output shaft, the nose portion being configured to have an accessory device mounted thereon, a shaft lock mechanism including a shaft lock actuator that is located at least adjacent to or on the nose portion and is configured to be moved by a user to engage the output shaft and prevent rotation thereof, the actuator being configured to be disabled from movement to engage the output shaft when an accessory device is mounted on the nose portion.

13 Claims, 6 Drawing Sheets

LOCKOUT APPARATUS FOR PROTECTING AN ATTACHMENT DEVICE MOUNTED ON ROTARY POWER TOOLS

BACKGROUND OF THE INVENTION

The present invention generally relates to small rotary handheld power tools, and more particularly to a method and apparatus for protecting an attachment device that is mounted on such power tools.

Small handheld power tools that perform drilling, sawing and other types of cutting and the like are known in the prior art and have been widely used by hobbyists, artisans, tradesmen and others in a wide variety of applications. Such rotary hand tools generally have a motor with a rotary output shaft that extends from a nose portion that is more recently configured to connect to various accessories or attachment devices. Some of these rotary hand tools are quite powerful for their size and are used by tradesmen in the building trades as spiral saws that use a side cutting rotary tool bit to penetrate and rapidly cut holes in drywall sheets and other material. The tools are usually always provided with a mechanism for holding such tool bits and are generally in the form of a collet that fits within a bore of the power tool output shaft that has a center bore for receiving a tool bit such as the spiral saw bit and a collet nut that can tighten the collet against the tool bit that is placed in the collet. To tighten the collet nut, the output shaft desirably has a shaft lock mechanism that can be manipulated to engage the output shaft and hold it from rotating so that the user can use a wrench or the like to tighten the nut.

Such tools can also be used with an attachment device that has a right angle shaft configuration that drives a circular saw blade for making under-cuts in building trim molding and the like for installing flooring material and tile. Other right angle attachment devices may be configured to drive a grinding wheel, a sanding pad or polishing pad.

Such a right angle attachment device has an input shaft that must be interconnected with the output shaft of the tool when the attachment device is mounted on the tool. The interconnection can present problems resulting from the relatively high speed operation, which together with some slight misalignment of the two shafts, can create undesirable levels of vibration. One way to minimize such vibration is to provide a flexible interconnection between the output shaft of the power tool and the input shaft of the attachment device.

While such a flexible interconnection can significantly reduce such vibration, some embodiments of such a flexible interconnection may be damaged if it is subjected to an excessive torque.

SUMMARY OF THE INVENTION

A power hand tool comprising an elongated housing with a nose portion having an opening concentric with a rotary output shaft, the nose portion being configured to have an accessory device mounted thereon, a shaft lock mechanism including a shaft lock actuator that is located at least adjacent to or on the nose portion and is configured to be moved by a user to engage the output shaft and prevent rotation thereof, the actuator being configured to be disabled from movement to engage the output shaft when an accessory device is mounted on the nose portion.

Embodiments are also directed to a method of protecting a flexible drive portion of a drive interconnection between an output shaft of a rotary power tool and an input shaft of an accessory device that also has an output shaft that is configured to be mounted on the power tool, wherein the power tool and the accessory device each have respective shaft lock mechanisms that are actuated by being moved into locking engagement by a user for preventing rotation of their respective output shafts, the method comprising providing a extension on the power tool shaft lock mechanism that is designed and configured to be in close proximity to the accessory device when the accessory device is mounted on the power tool, so that the extension prevents actuation of the power tool shaft lock mechanism.

DETAILED DESCRIPTION

Figure 1:
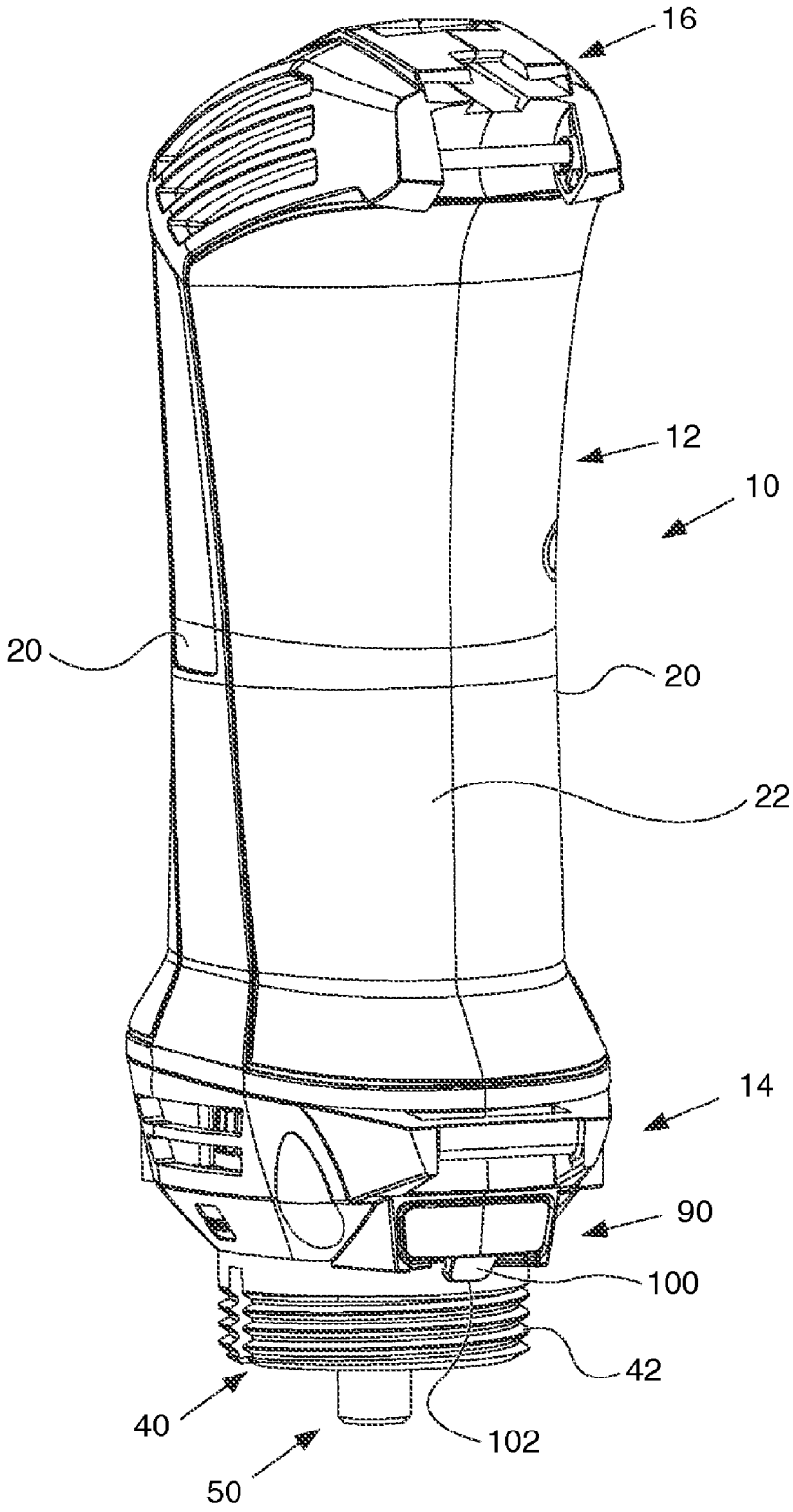
FIG. 1 is a plan view of a rotary handheld power tool that incorporates an embodiment of the present invention, largely showing the bottom thereof.

Embodiments of the present invention are directed to a power hand tool of the type that has an elongated housing with a nose portion, the nose portion being configured to have an accessory device attached thereto in addition to having a configuration that enables a bit holding mechanism to be used to hold a spiral cutting bit or the like. The power hand tool is also of the type that has a shaft lock mechanism located adjacent to the nose portion and configured to be moved by a user to have it engage the output shaft of the tool and prevent it from rotating. The shaft lock mechanism is provided to enable a user to hold the shaft from rotating while tightening a collet nut onto the threaded portions of the output shaft to securely hold a tool bit in a collet mechanism, for example.

When the power tool is coupled with an attachment device, the attachment device has an input shaft as well as an output shaft to which a tool bit, such as a saw blade, sanding pad, grinding wheel or the like, can be secured. The input shaft of the accessory device must be interconnected with the output shaft of the tool and as previously mentioned, this interconnection can create significant and undesirable vibration to the user in the event the interconnected shafts are not well aligned. The possible misalignment can be a result of manufacturing tolerances not being met, or the user not completely or properly tightening the accessory device to the tool, or from wear being experienced after a period of substantial use, among other possible causes. It is also known to those skilled in the art that manufacturing tolerances can be very strict which certainly can minimize vibration. However, very strict tolerances often increase the cost of manufacture.

One good way to reduce such vibration is to use a flexible interconnection between the two shafts, which is in the form of an elongated drive shaft that is preferably secured to the accessory device and extends forwardly into a noncircular cavity of an output shaft of the power tool to create a driving arrangement. The flexible shaft can be in the form of a plurality of small wires that are compressed under high pressure into a unitary shaft that preferably has a square outer configuration that engages a complementary square cavity in the output shaft of the tool.

It should be understood that the accessory device often requires its output shaft to be prevented from rotation so that saw blades or the like that are attached to it can be replaced. For this reason, an accessory device, such as a right angle accessory device previously described desirably includes its own shaft lock mechanism that also can be manipulated by the user to immobilize the output shaft for the usual reasons. While a user may certainly detach the accessory device from the power tool to perform such maintenance or replacement tasks, if the accessory device is mounted on the power tool, the lock out mechanism of the accessory device can certainly be used to perform such tasks. However, a user may attempt to use the power tool shaft lock mechanism to immobilize the accessory device output shaft. By doing this, substantial torque may be applied to the flexible interconnecting shaft that can result in damage to the shaft. Embodiments of the present invention prevent a user from using the power tool shaft lock mechanism when the accessory device is properly mounted on the power tool.

Turning now to the drawings and particularly FIG. 1, an elongated power tool, indicated generally at 10, is shown and has an elongated housing, indicated generally at 12, a nose portion, indicated generally at 14, and a rear end portion, indicated generally at 16. The housing has a top surface 18, side surfaces 20 and a bottom surface 22, and a motor is contained within the housing. The size of the housing 12 is such that most users can grip the tool with one hand with their fingers curling around under the bottom portion 22.

When a person is holding the tool 10 as described, their thumb is in position to operate a switch 32 (partially show in FIG. 4) which turns on the motor for operating the tool. The switch 32 is preferably designed so that can be slidingly moved between its ON and OFF positions. The tool 10 shown in FIG. 1 can have a power cord (not shown) that can be plugged into a source of AC power. It should be understood that power tools similar to that shown in FIG. 1 may incorporate battery packs and in such event, they may be slightly larger. The present invention may be used with such power tools.

Figure 5:
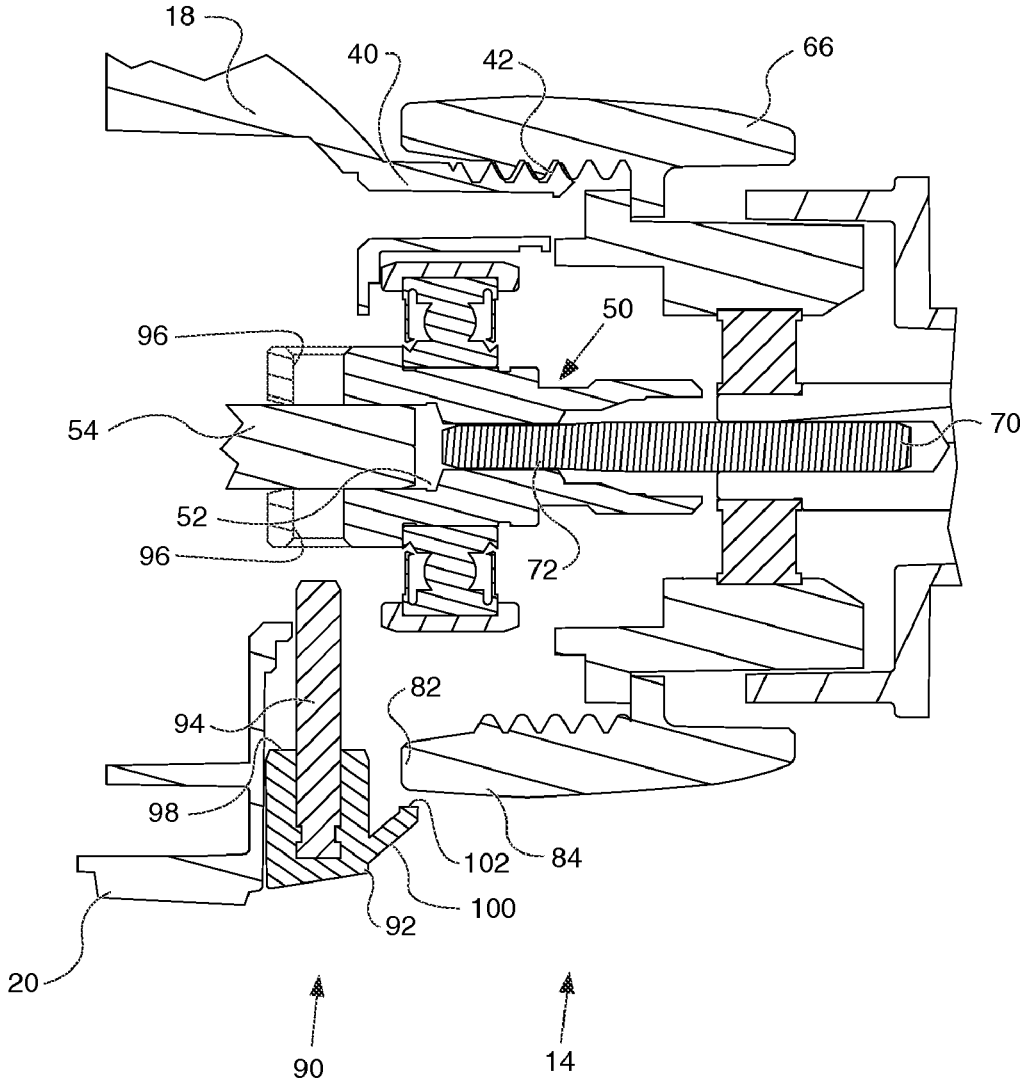
FIG. 5 is a cross section taken generally along the center line of the tool and attachment device shown in FIG. 4, with only portions of each being shown.

The tool 10 has an output shaft, indicated generally at 50, which is best shown in FIGS. 1 and 5, and which is configured to be able to accept a collet and collet nut for mounting a cylindrical tool bit, such as spiral bit, for example. The output shaft 50 is also configured to accept an interconnecting shaft of an attachment device that can be mounted on the nose portion 14 of the tool 10. The output shaft 50 has a rear bore 52 that is sized to receive a motor drive shaft 54 and is secured therein preferably by a crimping action.

The nose portion 14 has an attachment interface that is described in a co-pending patent application entitled "AN ATTACHMENT INTERFACE FOR ROTARY HAND TOOLS", Ser. No. 12/700,003, that is filed concurrently with this application and is incorporated by reference herein. The nose portion has a cylindrical wall, indicated generally at 40, which has outer threads 42 configured to receive a threaded collar of an attachment device that may be mounted on the nose portion 14.

Figure 2:
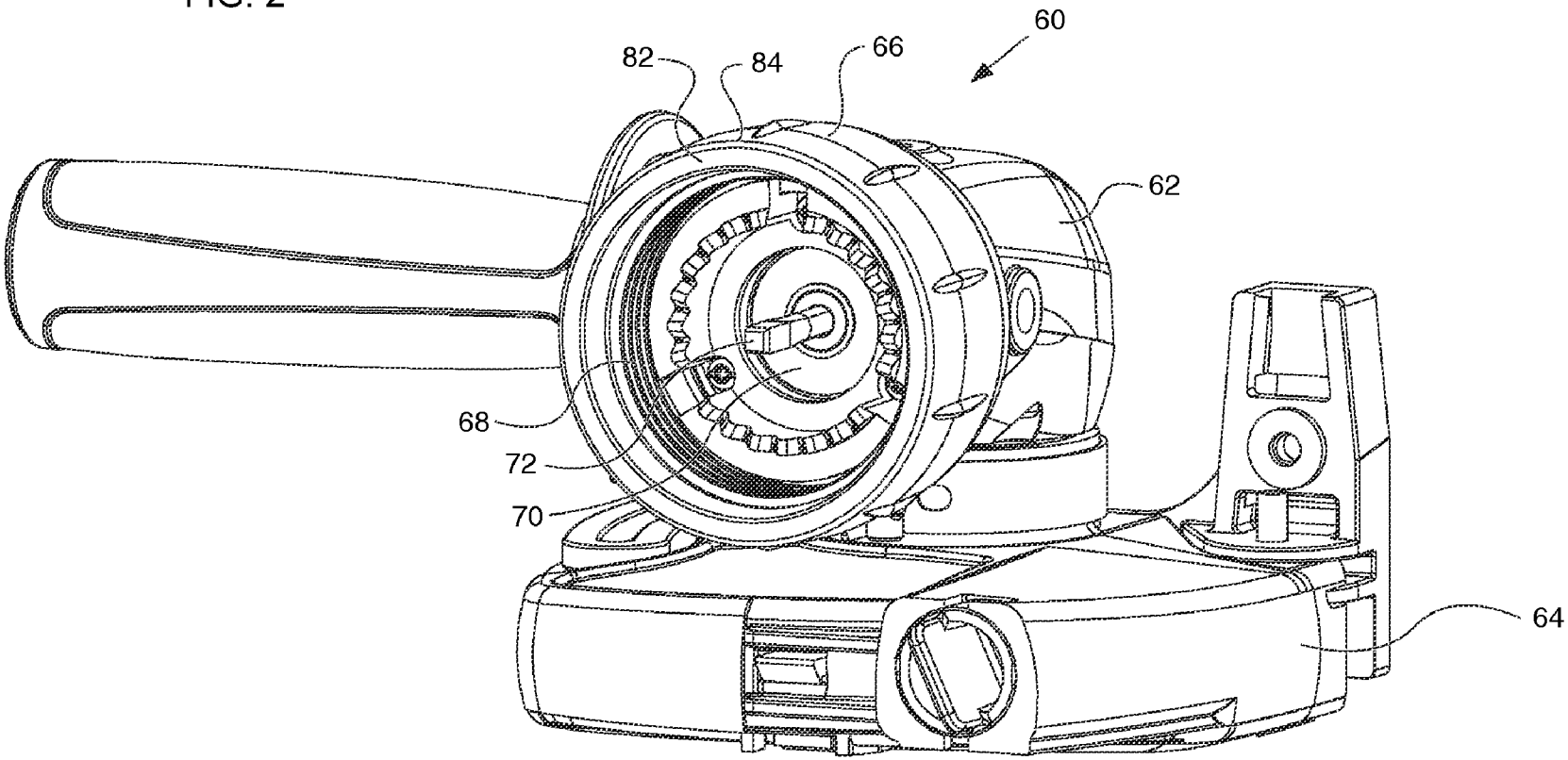
FIG. 2 is an isometric view of an attachment end of a right angle attachment device which also incorporates an embodiment of the present invention, with the attachment device being capable of being mounted on the power tool shown in FIG. 1.
Figure 3:
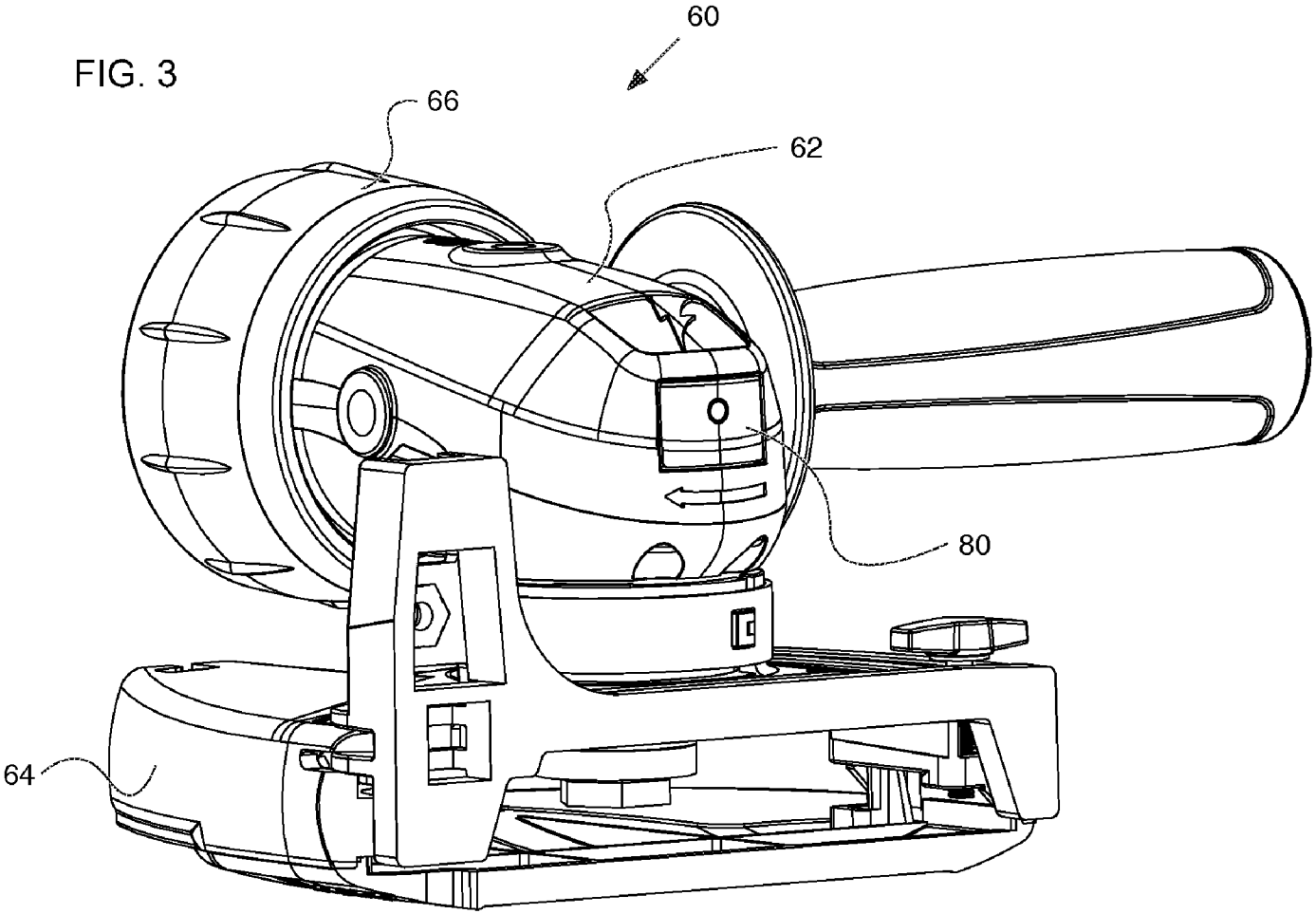
FIG. 3 is another isometric view of the end opposite the attachment end of the right angle attachment device shown in FIG. 2.

An attachment device is indicated generally at 60 in FIG. 2 and comprises a right angle saw attachment device which can be mounted on the power tool. The device will not be described in detail inasmuch as the present invention deals with only the interconnection of it with the tool on which it is mounted. In this regard, the device 60 has a right angle main housing 62 with a circular undercut saw housing portion 64 and a rotatable collar 66 with internal threads 68 that are sized and configured to thread the collar 66 onto the threads 42 of the nose portion 14 of the power tool 10.

The attachment device 60 has a flexible input shaft 70 of the type as previously described which has an outer end 72 with a square cross-section that is sized and configured to fit within the an intermediate drive portion of the output shaft 50 of the power tool 10. The input shaft 70 is preferably permanently secured such as by being crimped in a gear shaft in the attachment device 60 so that it will not be separated and possibly lost when the attachment device is removed from the power tool 10.

The attachment device 60 also has a shaft lock mechanism 80 which can be depressed by a user and has a pin or the like that engages a radial opening in an output shaft portion of the accessory device 60. While not shown in detail, it is similar to the shaft lock mechanism that is shown and will be described in connection with the power tool 10. The collar 66 has a front annular surface 82 that has a relatively large width resulting from a relatively wide wall thickness of the collar 66. This is provided to assure that the collar 66 is strong and will be durable over the useful life of the tool accessory device and provide a strong interconnection of the accessory device to the power tool 10. The collar 66 has an outer surface 84.

Referring to FIGS. 1, 4, 5 and 6, the power tool 10 has a shaft lock mechanism, indicated generally at 90, positioned on the nose portion 14, closely adjacent to the wall 40 having the threads 42. The shaft lock mechanism 90 has an outer pushbutton portion 92 that is preferably made of plastic or plastic-like material that is molded around a locking pin 94 that has a generally cylindrical shape and is sized to fit within one of the two radial bores 96 of the output shaft 50. The pushbutton portion 92 has an inner end face 98 that is configured to contact one end of a spring (not shown) which biases the shaft lock mechanism 90 outwardly so that it is disengaged from the output shaft 50 except when a user depresses the pushbutton portion 92.

Figure 4:
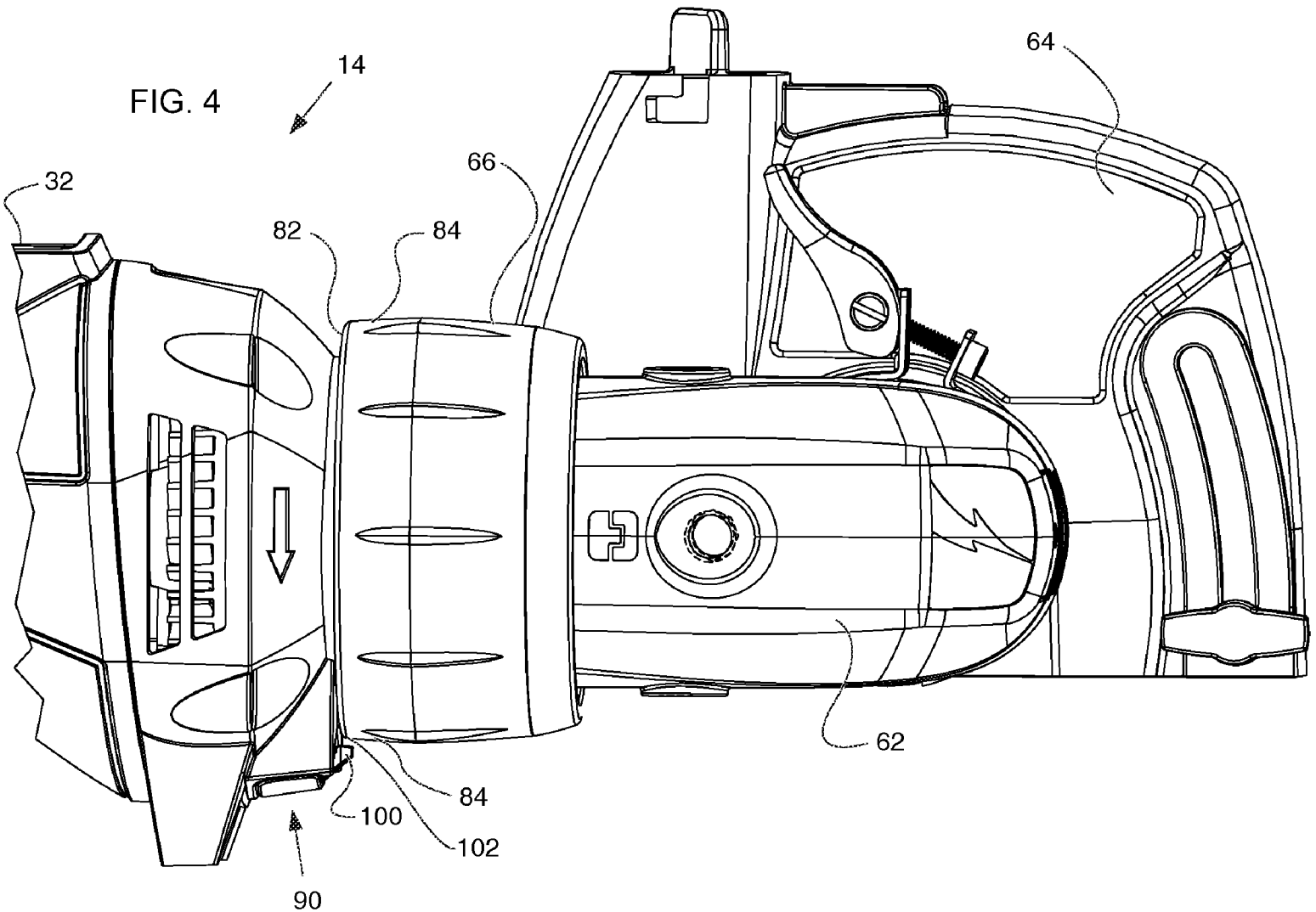
FIG. 4 is a side plan view of a portion of the power tool shown in FIG. 1 together with an attachment device shown in FIGS. 2 and 3 mounted onto the nose portion of the power tool.
Figure 6:
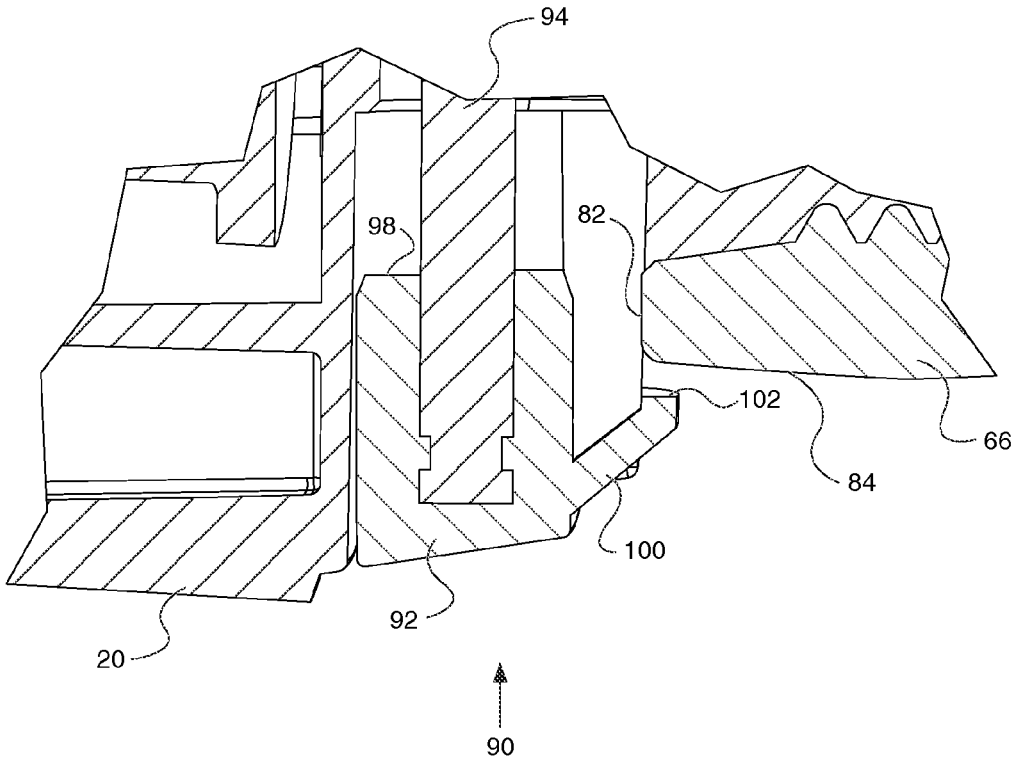
FIG. 6 is an enlarged view of a portion of the cross section shown in FIG. 5.

The pushbutton portion 92 also has a rib 100 that extends in a direction toward the accessory device 60 as well as slightly radially inwardly toward the output shaft 50. It has an end surface 102 that is in close proximity to the outer surface 84 of the collar 82 and is positioned to contact the outer surface 84 when the collar 66 has been threaded onto the threads 42 of the wall 40, as shown in FIGS. 4, 5 and 6. The interaction of the rib 100 and the collar 66 of the accessory device 60 prevents the shaft lock mechanism 90 of the tool 10 to be used to prevent rotation of the output shaft 50 and therefore a user must use the shaft lock mechanism 80 of the accessory device 60 if the user wants to immobilize the output shaft of the accessory device for the purpose of changing blades and the like. This prevents possible damage to the flexible shaft 70 during such activity.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A power hand tool comprising: an elongated housing with a nose portion having an opening concentric with a rotary output shaft of the hand tool, said nose portion being configured to have an accessory device mounted thereon; a shaft lock mechanism including a shaft lock actuator that is located at least adjacent to or on said nose portion and is configured to be moved by a user to engage said output shaft of the hand tool to prevent rotation thereof; said shaft lock actuator being configured and positioned to contact a portion of an accessory device when the accessory device is mounted on said nose portion of said power tool, and disable said shaft lock actuator from engaging said output shaft.

2. A power hand tool as defined in claim 1 wherein said nose portion includes a transition portion with an inclined outer surface extending radially inwardly toward the output shaft and a generally cylindrically shaped wall extending from said transition portion concentrically and forwardly and having a plurality of screw threads formed in an outer surface of said wall configured to have said accessory device with a screw threaded collar mounted on said nose portion, wherein the collar of said accessory device is screwed onto said nose portion of said hand tool to secure the same thereto.

3. A power hand tool as defined in claim 2 wherein said shaft lock actuator comprises a pushbutton located generally coextensive with said transition portion, wherein said pushbutton is configured to be moved inwardly toward said output shaft into engagement therewith.

4. A power hand tool as defined in claim 3 wherein said pushbutton has a surface extending forwardly in a direction generally toward said output shaft and positioned to contact an end portion of the screw threaded collar of the accessory device when the accessory device is mounted on said nose portion of the hand tool and prevent said pushbutton from being moved inwardly into engagement with said output shaft.

5. A power hand tool as defined in claim 4 wherein said surface comprises a rib located on said pushbutton configured and designed to contact said end portion of said collar.

6. A power hand tool as defined in claim 5 wherein the accessory device has an input shaft that connects with said output shaft of said hand tool, and the accessory device further comprises a second shaft lock mechanism for locking said input shaft of the accessory device.

7. A lockout device for a hand held power hand tool that has an elongated housing with a nose portion having an opening concentric with a rotary output shaft of the hand tool, with the nose portion being configured to have an accessory device mounted thereon, the hand tool having a shaft lock mechanism including a shaft lock actuator that is located at least adjacent to or on the nose portion and configured to be moved by a user and cause the shaft lock actuator to engage said output shaft of the hand tool and prevent rotation thereof, said lockout device comprising:

said shaft lock actuator having a surface extending forwardly in a direction generally toward the output shaft and positioned to contact a portion of the accessory device when the accessory device is mounted on the hand tool and prevent said shaft lock actuator from engaging said output shaft and prevent rotation thereof.

8. A lockout device as defined in claim 7 wherein said shaft lock actuator comprises a pushbutton configured to be moved inwardly toward the output shaft into engagement therewith.

9. A lockout device as defined in claim 8 wherein said pushbutton has said surface extending forwardly in a direction generally toward the output shaft and positioned to contact an end portion of a screw threaded collar of the accessory device when the accessory device is mounted on the hand tool and prevent said pushbutton from being moved inwardly into engagement with the output shaft.

10. A lockout device as defined in claim 9 said surface comprises a rib located on said pushbutton configured and designed to contact the end portion of the collar of the accessory device.

11. A method of protecting a flexible drive portion of a drive interconnection between an output shaft of a rotary power tool and an input shaft of an accessory device that also has an output shaft that is configured to be mounted on the power tool, wherein the power tool and the accessory device each have respective shaft lock mechanisms that are actuated by being moved into locking engagement by a user for preventing rotation of their respective output shafts, said method comprising:

providing an extension on the power tool shaft lock mechanism that is designed and configured to be in close proximity to the accessory device when the accessory device is mounted on the power tool, so that the extension prevents actuation of the power tool shaft lock mechanism.

12. A method as defined in claim 11 wherein the shaft lock mechanism of the power tool comprises a pushbutton that is depressed by a user into locking engagement with the power tool output shaft.

13. A method as defined in claim 12 wherein said pushbutton has an rib extending to a location adjacent the accessory device when the accessory device is mounted on the power tool, so that the pushbutton is precluded from being depressed by the accessory device.

* * * * *